United States Patent [19]

Booth

[11] 4,047,249

[45] Sept. 13, 1977

[54] PROTECTIVE HELMET AND FACE SHIELD ASSEMBLY THEREFOR

[76] Inventor: Robert G. Booth, 6661 Banning Drive, Oakland, Calif. 94611

[21] Appl. No.: 644,848

[22] Filed: Dec. 29, 1975

[51] Int. Cl.[2] ..... A42B 3/00; A61F 9/02

[52] U.S. Cl. ..... 2/10; 2/434; 2/424

[58] Field of Search ..... 2/10, 14 J, 14 K, 8, 2/205, 173, 6, 9, 13, 434, 435, 424; 351/49

[56] References Cited

U.S. PATENT DOCUMENTS

| | | | |
|---|---|---|---|
| 2,368,117 | 1/1945 | Damian | 351/49 |
| 2,511,329 | 6/1950 | Craig | 2/13 UX |
| 2,901,752 | 9/1959 | Granger | 2/13 |
| 2,923,944 | 2/1960 | Lindblom | 2/434 |
| 3,225,357 | 12/1965 | Johnson | 2/14 J |
| 3,488,215 | 1/1970 | Shepherd et al. | 2/14 K |
| 3,605,114 | 9/1971 | Hanlein et al. | 2/10 |
| 3,668,705 | 6/1972 | Garbisch | 2/10 |
| 3,825,952 | 7/1974 | Pershing | 2/205 X |

*Primary Examiner*—Werner H. Schroeder
*Assistant Examiner*—Peter Nerbun

[57] ABSTRACT

A protective helmet for use by race drivers, police riot squads...etc. incorporates a face shield assembly involving means for overcoming problems of breakage, glare and fogging by associating with a face shield of substantially unbreakable material, coatings or layers of polarized and/or light effecting material treated for fog prevention.

3 Claims, 3 Drawing Figures

PROTECTIVE HELMET AND FACE SHIELD ASSEMBLY THEREFOR

The invention relates to protective helmets with face shields and more particularly to an improved helmet and face shield assembly.

Current practice as to protective helmets, involves the use of a helmet with an eye opening and a face shield of transparent material such as plastic, removably affixed to the helmet over the eye opening.

Such helmets are worn by drivers in road racing, snow mobiling, boat racing, and by police riot squads. Such a helmet presents many problems such as breakage, glare and loss of visibility due to fogging.

Attempted solution to one of these problems, namely that of glare, is for the user of the helmet to wear polarized eye glasses, but such has caused itching and sweating in the area of the nose, and often fog up. And upon the occasion of the first bump, such glasses are apt to be disoriented or shaken loose, thus creating havoc with the driver of a vehicle, and in the case of the race driver, such occurance could result in a very tragic situation.

Among the objects of the present invention are:

1. To provide a novel and improved protective helmet assembly;
2. To provide a novel and improved protective helmet assembly which is capable of solving one or more of the problems of current helmets;
3. To provide a novel and improved face shield assembly for a protective helmet;
4. To provide a novel and improved face shield assembly capable of solving the problem of breakage;
5. To provide a novel and improved face shield assembly capable of solving the problem of glare;
6. To provide a novel and improved face shield assembly capable of solving the problem of fogging;
7. To provide a novel and improved face shield assembly capable of solving more than one of such problems;
8. To provide a novel and improved face shield assembly in which component parts are replaceable;
9. To provide a novel and improved face shield assembly which will minimize surface to surface contact with a helmet when attached thereto.

Additional objects of the invention will be brought out in the following description of a preferred embodiment of the same taken in conjunction with the accompanying drawings wherein.

Figure 3:
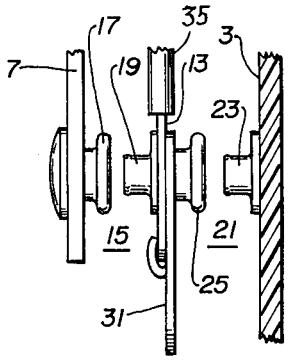
FIG. 3 is an enlarged view of a detail of the helmet assembly of FIG. 1.
Figure 1:
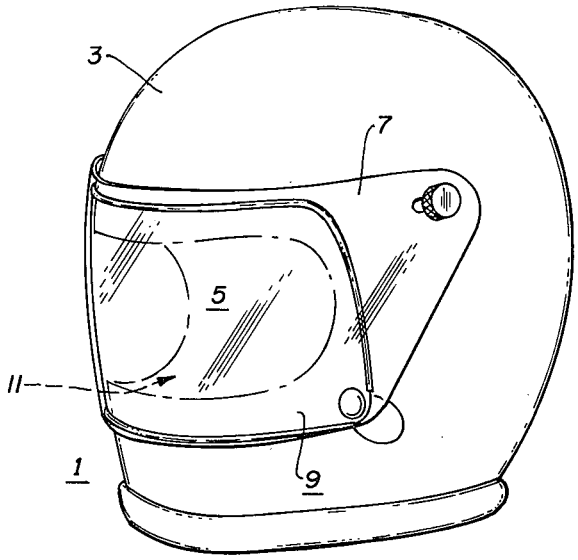
FIG. 1 is a three-dimensional view of a helmet assembly embodying the present invention.
Figure 2:
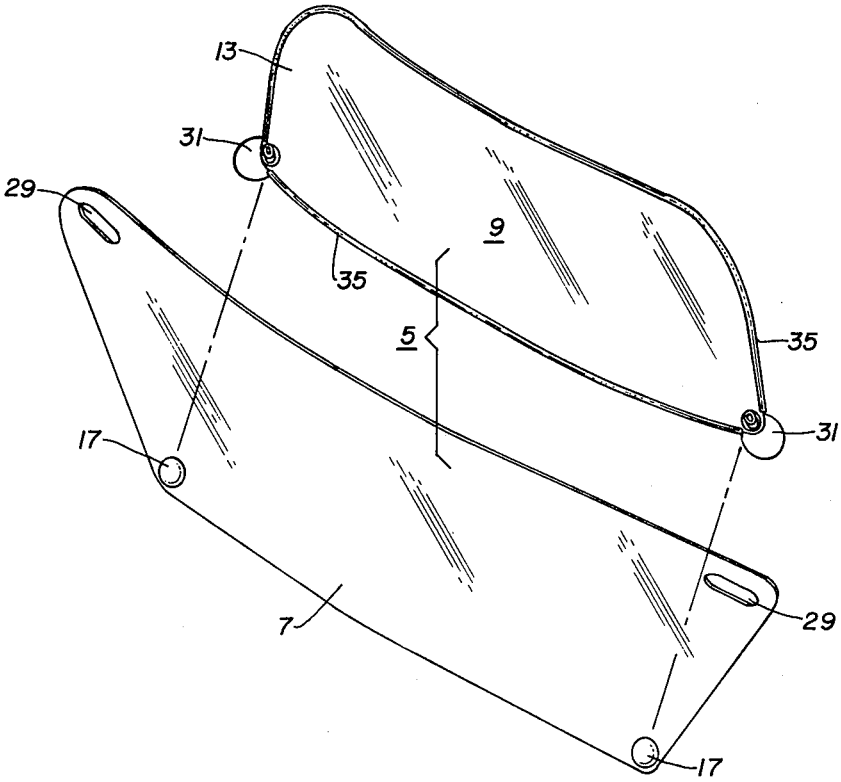
FIG. 2 is an exploded view of a face shield assembly involved in the helmet assembly of FIG. 1.

In general, the invention entails a helmet assembly 1 including a helmet 3 and a face shield assembly 5 comprising a face shield 7 and means 9 associated with the face shield and united therewith for reducing glare. Fogging may be avoided by suitably coating a surface of one or more of these components, and preferably the glare preventing means.

For details of the invention in its preferred form, the helmet may be of any conventional type provided with an eye opening 11 adapted to be covered by the face shield assembly, which includes the face shield, to the inner side of which is affixed or united, the glare preventing means, in the form of a layer 13 of light polarizing material, which in turn may be coated with a fog prevention chemical.

In its preferred form, the face shield is of plastic material of low memory characteristic, such as LEXAN or material such as buturate acrylic acitate, such material being substantially unbreakable in response to impact. As to size and shape, the face shield may conform to that of a conventional face shield, which embodies an area substantially greater than the area of the eye opening.

To the inner side of the face shield is affixed the layer of polarized plastic, preferably of smaller area than the face shield, but still of sufficient area to cover the eye opening when the assembly is applied to the helmet. This polarized layer in the preferred form, is a sheet of polarized plastic affixed at its lower corners to the corresponding lower corners of the face shield by snap fasteners 15, with the male component 17 of each snap fastener preferably anchored to the face shield and the female component 19 to the polarized sheet.

This assembly of the polarized sheet to the face shield may then be affixed to the helmet by similar snap fasteners 21, with the male component of these latter fasteners affixed to the helmet and the associated female components 25 affixed to the polarized sheet.

With these snap fasteners components thus related, the male and female components on opposite sides of the polarized sheet, may be affixed by a common rivet through the sheet, thus placing the proximate snap fasteners in alignment, whereby pressure applied in assembling a face shield assembly to a helmet, will assure that the face shield and polarized sheet are adequately secured to each other.

With the face shield assembly thus snap fastened to the helmet, the upper corners of the face shield may be fastened in a conventional manner to the helmet by providing elongated corner openings 29 enabling it to receive fastening screws for threadedly engaging internally threaded studs embedded in the helmet.

To facilitate separation of the face shield assembly from the helmet when desired, as for servicing or cleaning, a substantially stiff tab 31 preferably of metal, is installed between the polarized sheet and each of the proximate female components of the associated snap fasteners. Application of finger pressure applied behind such tabs will enable one to readily pry the face shield assembly from the helmet, whereas in the absence of such tabs, substantial difficulty might be experienced in performing such function.

Of the component parts making up the face shield assembly, the polarized sheet is the more expensive component. By assembling it behind the face shield as described, it is thus protected by the less expensive but more impact resistance face shield, although when so related to the face shield, it might be exposed to surface to surface contact with the helmet, as might cause scratching and other damage to the expensive polarized sheet.

As a precautionary protective measure against such probability, spacer means are interposed between the polarized sheet and the helmet, preferably along an edge or edges of the polarized sheet.

This preferably may take the form of a metal trim 35 on the polarized sheet, which preferably encloses the edge of the polarized sheet and provides a raised edge which will engage the helmet in advance of the polarized sheet to which it is attached, thereby precluding such surface to surface engagement. Such metal trim preferably stops short of the lower corners.

When the face shield assembly is installed on the helmet, the face shield 7 will not only pressure the metal trim into contact with the helmet surface, but it will itself, pressure contact the metal trim, thus creating an air layer between the face shield and polarizing sheet, with openings to the atmosphere in the lower region, particularly around the lower corners. This provides a minimal air flow which will enable such air layer to reach a temperature somewhere between that of the atmosphere against the external surface of the face shield and that on the helmet side of the polarizing sheet, which approaches body temperature. If the differential temperature across the face shield and across the polarizing sheet is sufficient to discourage condensation on either, then fogging will be avoided.

However, in very cold weather a coating of any known fog deterrent chemical will assure freedom from fogging, and such fog deterrent may be utilized in the absence of such exposed layer of air.

The preferred embodiment of the invention as thus described, is subject to modification and alteration without departing from the underlying principles of the invention.

For example, the polarized material may be incorporated into or onto the face shield in lieu of a separate sheet as described, or the separate polarized sheet may be vacuum sealed to the surface of the face shield by heat sealing, ultrasonic bonding, or chemical welding.

In place of the spacing means in the form of the metal edging on the polarized sheet, one can provide dimples or other form of protuberances on the polarized sheet adjacent the upper edge thereof.

Also, it is within the contemplation of the present invention to vary the transparancy factor of the face shield for example by progressive shading, in much the same manner as automobile windshields, and incorporate into the face shield assembly, light crystals, either as a coating or as part of either component makeup to automatically respond to changes in light intensity to maintain maximum light transmission under prevailing conditions.

The expression "eye opening" applies not only to the type of helmet illustrated, but also to the standard type wherein the eye opening continues to the bottom of the helmet to expose the entire lower portion of the face to view.

From the foregoing, it will be apparent that the invention as illustrated and described, fulfills all the objects attributed thereto, and while the invention has been illustrated and described in considerable detail, I do not wish to be limited in my protection to the specific details as illustrated and described, except as may be necessitated by the appended claims.

I claim:

1. A helmet assembly comprising a helmet having an opening for the eyes, a face shield assembly for said helmet, said face shield assembly including a face shield adapted to cover an area substantially greater than said eye opening, means removably affixing said face shield to said helmet as a covering over said opening, and glare reducing means affixed to said face shield for reducing glare and removable with said face shield as a unit, said glare reducing means being protected by said face shield and covering said eye opening and having a rim on the periphery thereof and projecting outwardly from the plane of said glare reducing means to contact the surface of said helmet to maintain said glare reducing means spaced apart from said helmet to substantially prevent surface contact between said glare reducing means and said helmet, whereby marring of the surface of said glare reducing means is avoided, said glare reducing means and said face shield being spaced apart from each other by said rim to provide an air gap therebetween and spaced openings in said rim to provide air circulation between said face shield and said glare reducing means.

2. A face shield assembly for use with a helmet having an opening for the eyes, said face shield assembly including a face shield adapted to cover an area substantially greater than said eye opening, means for removably affixing said face shield to the helmet as a covering over said opening, glare reducing means for reducing glare, said glare reducing means being protected by said face shield and being of a size to cover said eye opening, and including a polarized sheet of plastic, and means for mechanically fastening said polarized sheet in position between said face shield and the helmet and spanning the eye opening, said mechanical fastening means including a two component snap fastener, one part anchored to said polarized sheet, and another two component snap fastener with one component anchored to said polarized sheet and the other component anchored to said face shield, all said snap fastener components being in alignment, a rim connected to the outer periphery of said glare reducing means to project outwardly therefrom into contact with the helmet when assembled thereto to maintain the helmet and said glare reducing means in spaced apart relationship and into contact with said face shield to define a gap between said glare reducing means and said face shield and spaced openings in said rim to provide a gap open to the outside of the helmet whereby air is circulated between said face shield and said glare reducing means.

3. A helmet assembly in accordance with claim 2, characterized by a substantially stiff tab affixed to said face shield assembly in the area of each of said snap fasteners and extending beyond the boundaries thereof to facilitate removal of said face shield assembly from said helmet.

* * * * *